US009421406B2

(12) United States Patent
Seebaluck et al.

(10) Patent No.: US 9,421,406 B2
(45) Date of Patent: Aug. 23, 2016

(54) FREIGHTER CARGO FIRE PROTECTION

(71) Applicant: Kidde Technologies, Inc., Wilson, NC (US)

(72) Inventors: Dharmendr Len Seebaluck, Wake Forest, NC (US); Adam Chattaway, Windsor (GB); Tadd F. Herron, Greenville, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 197 days.

(21) Appl. No.: 13/959,053

(22) Filed: Aug. 5, 2013

(65) Prior Publication Data

US 2015/0034342 A1 Feb. 5, 2015

(51) Int. Cl.

| | |
|---|---|
| ***A62C 3/08*** | (2006.01) |
| ***A62C 37/08*** | (2006.01) |
| ***A62C 37/11*** | (2006.01) |
| ***A62C 37/12*** | (2006.01) |
| ***A62C 37/36*** | (2006.01) |
| ***A62C 37/44*** | (2006.01) |
| ***A62C 35/68*** | (2006.01) |
| *A62C 99/00* | (2010.01) |

(52) U.S. Cl.

CPC ..... *A62C 37/44* (2013.01); *A62C 3/08* (2013.01); *A62C 35/68* (2013.01); *A62C 99/0045* (2013.01)

(58) Field of Classification Search

CPC ..... A62C 37/04; A62C 37/36; A62C 37/44; A62C 3/08; A62C 35/68; A62C 3/0207; A62C 37/08; A62C 37/11; A62C 37/12; B64D 2045/009; G08B 17/12; G08B 25/10; F24F 2011/0095; Y10S 239/15; A62B 7/14

USPC ..... 169/19, 47, 53, 54, 56, 57, 90, 59–62, 169/70, DIG. 3; 244/129.2, 136; 239/171

See application file for complete search history.

(56) References Cited

U.S. PATENT DOCUMENTS

| | | | | | |
|---|---|---|---|---|---|
| 2,159,649 | A * | 5/1939 | Alford | 361/111 | |
| 3,986,560 | A * | 10/1976 | Heath | A62C 3/06 | 169/28 |
| 4,351,394 | A * | 9/1982 | Enk | A62C 3/08 | 169/16 |
| 4,646,848 | A * | 3/1987 | Bruensicke | A62C 3/08 | 169/62 |
| 4,726,426 | A * | 2/1988 | Miller | A62C 99/0018 | 169/16 |
| 5,038,867 | A * | 8/1991 | Hindrichs | A62C 35/58 | 169/62 |
| 5,186,260 | A * | 2/1993 | Scofield | A62C 3/006 | 169/61 |

(Continued)

*Primary Examiner* — Arthur O Hall
*Assistant Examiner* — Joseph A Greenlund
(74) *Attorney, Agent, or Firm* — Cantor Colburn LLP

(57) ABSTRACT

An automated fire protection system for a freighter such as an aircraft may include a single fire retardant source for a first deck and a second deck. The system may further include a plurality of sensors for detecting fire and a plurality of nozzles for dispersing the retardant, wherein each nozzle is paired with one of the plurality of sensors. Once a fire is detected by one of the sensors, the fire protection system may eject fire retardant through only one or more nozzles paired with the sensor that detected the fire. Because retardant may be accurately dispersed close to the detected fire location through less than the plurality of nozzles, an amount of on-board retardant may be decreased, thereby decreasing weight of the fire suppression system. In an embodiment, the fire retardant may only be discharged during the descent, further decreasing the weight of the fire system.

18 Claims, 3 Drawing Sheets

(56) References Cited

U.S. PATENT DOCUMENTS 5,303,402 A * 4/1994 McLaughlin et al. ..... 455/186.1
7,066,274 B2 * 6/2006 Lazzarini ..... B64D 25/00 169/16
7,658,232 B2 * 2/2010 Anderson ..... A62C 3/14 169/37
7,806,195 B2 * 10/2010 Popp ..... A62C 3/08 169/14
7,849,931 B2 * 12/2010 Ng ..... A62C 3/08 169/16
8,302,883 B2 * 11/2012 Short ..... F02M 31/125 219/517
8,387,712 B2 * 3/2013 Flynn ..... A62C 31/02 169/41
8,678,101 B2 * 3/2014 Gatsonides ..... A62C 3/08 169/16
8,925,642 B2 * 1/2015 Meier ..... A62C 3/08 169/11
2006/0021652 A1 * 2/2006 Surawski ..... B64D 37/32 137/209
2006/0131035 A1 * 6/2006 French ..... A62C 13/64 169/37
2006/0272830 A1 * 12/2006 Fima ..... E03B 1/00 169/16
2007/0221388 A1 * 9/2007 Johnson ..... A62C 35/68 169/16
2010/0236796 A1 * 9/2010 Chattaway et al. ..... 169/46
2011/0247837 A1 * 10/2011 Lee ..... A62C 35/58 169/37
2012/0012346 A1 * 1/2012 Chattaway ..... A62C 99/0018 169/43
2012/0217027 A1 * 8/2012 Chattaway ..... A62C 99/0018 169/46
2012/0217028 A1 * 8/2012 Chattaway ..... A62C 99/0018 169/62
2014/0110137 A1 * 4/2014 Ribarov ..... A62C 3/08 169/44
2014/0158382 A1 * 6/2014 Ferguson ..... A62C 3/08 169/46
2014/0353427 A1 * 12/2014 Meckes ..... A62C 3/08 244/129.2
2015/0034340 A1 * 2/2015 Ronpagel ..... A62C 35/68 169/16

* cited by examiner

FREIGHTER CARGO FIRE PROTECTION

TECHNICAL FIELD

The present teachings relate to the field of fire protection and, more particularly, to a system for suppressing and containing fire during transportation of cargo in a cargo freighter such as an aircraft.

BACKGROUND

The frequency of aircraft freighter main deck cargo fires has increased over the years. Recent NTSB Safety Recommendations to the FAA (Nov. 28, 2012 A-12-68 through 70) suggest various guidelines, including: developing and implementing fire detection system performance requirements for the early detection of fires originating within cargo containers and pallets (A-12-68). (This safety recommendation supersedes Safety Recommendation A-07-98, which is classified "Closed-Acceptable Action/Superseded."); ensuring that cargo container construction materials meet the same flammability requirements as all other cargo compartment materials in accordance with Title 14 Code of Federal Regulations 25.855. (A-12-69); and requiring the installation and use of active fire suppression systems in all aircraft cargo compartments or containers, or both, such that fires are not allowed to develop (A-12-70).

Conversion of passenger aircraft to freighter aircraft is a common practice. Passenger aircraft typically includes a cargo hold or deck for transporting passenger baggage and other cargo and a main deck for transporting passengers. The cargo deck of a passenger aircraft typically includes smoke detection and fire suppression, for example using smoke and/or heat detectors for fire detection and an extinguishing gas or retardant source such as one or more Halon or other fire retardant canisters for dispersion of suppressant. Passenger deck fire suppression typically includes hand-held fire extinguishers delivered by an operator. System level fire protection with the use of an extinguishing gas source in a passenger cabin is not standard practice as this environment is an occupied space and use of portable fire extinguisher is common practice.

Conversion of passenger aircraft to freighter aircraft is a common practice. Passenger aircraft typically include a cargo hold for transporting passenger baggage other cargo and a main deck for transporting passengers. The cargo hold of a passenger aircraft typically includes a system for detecting fires, for example using smoke and/or heat detectors inside the cargo hold, and a system for controlling fires through use of fire resistant materials, reducing airflow, and flooding the entire cargo hold with active fire suppressing or inert gases that are remotely discharged from the flight deck. The passenger compartment on the main deck typically relies on the flight crew for fire detection, with the exception of certain spaces such as lavatories and, in some cases, galleys. Fire suppression in the passenger compartment typically uses hand held portable extinguishers operated by the flight crew. A total flooding approach to fire suppression in a passenger compartment is not typically standard practice as this space is occupied by humans.

Conversion of a passenger aircraft to an aircraft that can carry freight in place of passengers on the main deck typically includes the addition of a fire or smoke detection system, fire resistant main deck cargo liners, and a way to deprive the fire of oxygen to control the fire. Fire protection within existing cargo holds is not typically modified during conversion of the aircraft from a passenger plane to a freighter. Freighter aircraft have typically used decompression of the main deck cargo space as the technique to deprive the fire of oxygen, this approach is commonly referred to as passive fire suppression. For decompression to be an effective technique for controlling a main deck fire, the aircraft must be flying at an altitude high enough that the oxygen is forced out of the aircraft and the ambient oxygen available is insufficient to allow the fire to grow. Typically, the minimum altitude used for effectively controlling a main deck fire is 25,000 feet above sea level. The overall effectiveness of this approach has been questioned (reference the NTSB Safety Recommendations discussed above), as the aircraft must eventually descend to land, which increases oxygen levels and can cause the smoldering fire to reignite and expand out of control. The NTSB has thus recommended the addition of an active fire suppression system to the main deck fire protection scheme of freighter aircraft.

To apply the same total flooding active fire suppression techniques on the main deck that are used for the standard cargo holds of passenger aircraft is problematic due to the large volume of the main deck cargo compartment relative to the cargo holds of the lower deck. The weight of a fire detection and suppression system increases with the volume of area to be protected, for example because the volume of gas is increased. Aviation products/systems are particularly sensitive to increased weight, for example because the cost of hourly operation from fuel and other costs increases as payload weight increases.

For example, an initial discharge system (i.e., high rate discharge, HRD) for a lower deck cargo hold of a 747-400 may require about 110 pounds of Halon to achieve a 6.8% maximum concentration forward and 6.2% aft. This quantity of Halon provides a 5% Halon concentration in about 2 minutes and a maximum concentration in about 3 minutes. A metered discharge system (i.e., low rate discharge, LRD) for a cargo deck may require about 160 pounds of Halon to achieve a sustained concentration of about 3.7% forward for a sustained duration of about 3% for a duration of greater than 195 minutes. An HRD system for a main deck of a 747-400 may require about 294 pounds of Halon to achieve a 7.0% maximum concentration. This quantity of Halon provides a 5% Halon concentration in about 40 seconds and a maximum concentration in about 1 minute. An LRD system for the main deck may require about 920 pounds of Halon to achieve a sustained concentration of about 3.2% for a duration of greater than 90 minutes. Halon gross weight for the 747-400 is about 410 pounds for the lower deck cargo holds and about 1680 pounds for the main deck.

A fire suppression system and method is disclosed in US Pat. Pub. 2010/0236796, which is incorporated herein by reference in its entirety.

A fire suppression and containment system that assists in meeting these recommendations, improves detection time for smoke/ fires, reduces fire damage, and decreases weight compared to some other fire protection systems would be desirable.

SUMMARY

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment, a fire suppression system for an aircraft including at least a first deck and a second deck may include a fire retardant source and a first fire suppression system component for the first deck. The first fire suppression system component may include a plurality of first sensors on the first deck for detecting a fire and a plurality of first retardant nozzles on the first deck, wherein each first retardant nozzle is in fluid communication with the fire retardant source and at least one first retardant nozzle is paired with one of the first sensors. The fire suppression system may further include a second fire suppression system component for the second deck, including a plurality of second sensors on the second deck for detecting a fire and a plurality of second retardant nozzles on the second deck, wherein each second retardant nozzle is in fluid communication with the fire retardant source and at least one second retardant nozzle is paired with one of the second sensors.

In another embodiment, a fire suppression system may include a fire retardant source, a primary release valve in fluid communication with the fire retardant source, a first conduit and a second conduit each in fluid communication with the primary release valve, and a first fire suppression system component for a first deck in fluid communication with the first conduit. The first fire suppression system component may include a plurality of first deck sensors for detecting a fire, a plurality of first deck secondary release valves, wherein each first deck secondary release valve is uniquely paired with one of the plurality of first deck sensors, and a plurality of first deck fire retardant delivery nozzles, wherein each first deck fire retardant delivery nozzle is uniquely paired with one of the plurality of first sensors. The fire suppression system may further include a second fire suppression system component for a second deck in fluid communication with the second conduit, the second fire suppression system component including a plurality of second deck sensors for detecting a fire, a plurality of second deck secondary release valves, wherein each second deck secondary release valve is uniquely paired with one of the plurality of second deck sensors, a plurality of second deck fire retardant delivery nozzles, wherein each second deck fire retardant delivery nozzle is uniquely paired with one of the plurality of second sensors.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

One or more embodiments of the present teachings may result in a fire protection system, for example a fire detection and suppression system, that more quickly detects a fire within a freighter bay than some prior systems. In an embodiment, a fire suppression system may more precisely disperse a fire retardant to a required location than is found with some systems, for example systems that flood an entire open space with retardant. Further, a fire suppression system in accordance with an embodiment of the present teachings may have a reduced weight compared to some other fire suppression systems, thereby decreasing freighter operational costs. An embodiment of the present teachings may include one or more of several elements of the present teachings as described below.

Figure 1:
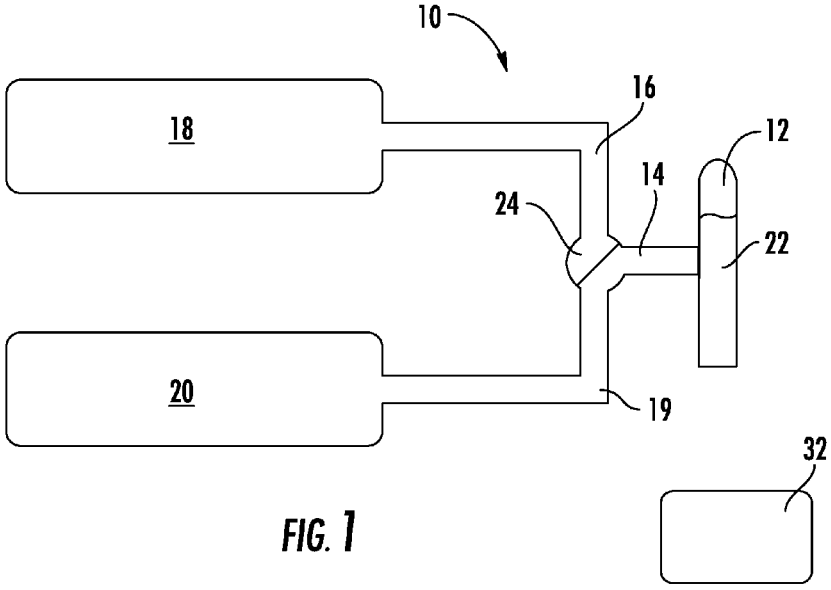
FIG. 1 is a schematic plan view of a fire protection system for two or more freighter decks, such as a main deck and a cargo deck.

FIG. 1 depicts a fire suppression system 10 in accordance with an embodiment of the present teachings. As depicted in FIG. 1, a fire retardant source 12, such as one or more retardant canisters containing an extinguishing gas 22 such as Halon or another extinguishing gas, is in fluid communication, for example through one or more primary conduits 14 and secondary conduits 16, 19 with both a cargo deck 18 retardant dispersal system and a main deck 20 retardant dispersal system. The retardant 22 is delivered from the retardant source 12 to the fire location using, for example, one or more primary release valves, diverters, or frangible disks 24. Using a fire retardant source 12 in fluid communication with both the cargo deck 18 and the main deck 20 reduces weight by eliminating redundant retardant sources, for example a first retardant source for the cargo deck 18 and a second retardant source for the main deck 20.

Figure 2:
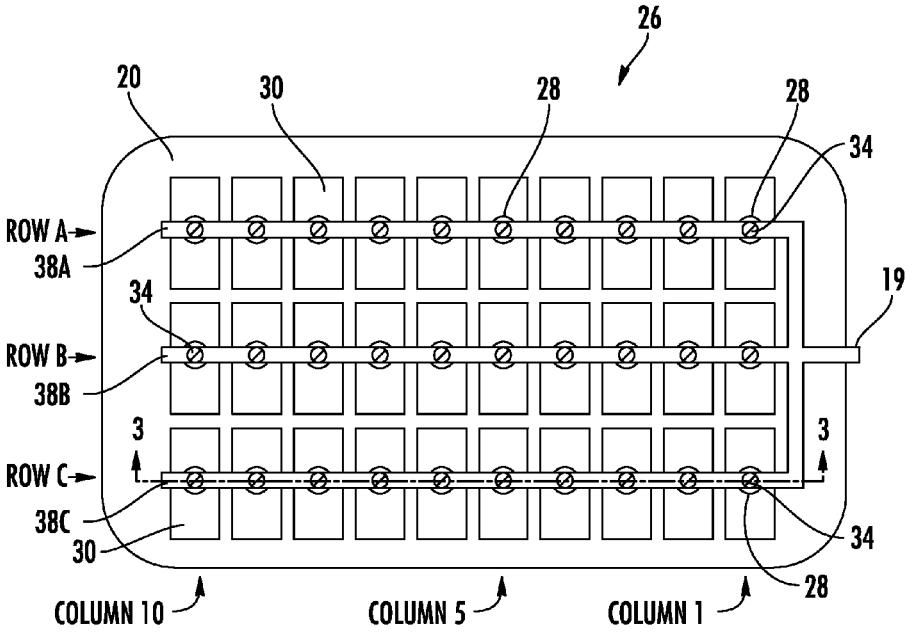
FIG. 2 is a schematic plan view of a fire protection system component for a deck of a cargo freighter.

For illustration, FIG. 2 depicts a plan view of a fire suppression system component 26 for the main deck 20, which may be repeated for the cargo deck 18. It will be understood that the embodiments depicted in each of the FIGS. are generalized schematic illustrations and that other components may added or existing components may be removed or modified. In operation, one or more sensors 28, such as a smoke detector, heat detector, or flame detector (ultraviolet, infrared, near-infrared, etc.), continually monitors for smoke and/or fire on the main deck 20. The main deck 20 and the cargo deck 18 may include a plurality of portable cargo or shipping containers 30 (boxes, pallets, cargo container, etc.) for storing cargo during transport. For illustration purposes only, the shipping containers 30 are arranged in an array of three rows, A, B, C, and 10 columns 1-10. In this embodiment, at least one sensor 28 directly overlies each shipping container 30.

Upon sensing a fire event at a sensor location on the main deck 20, the primary release valve 24 is configured, for example by a controller 32, into a release position such that retardant 22 is released from the retardant source 12 and directed to the main deck 20 through conduit 19. The controller 32 may be, for example, a computer device in wired or wireless communication with the primary release valve 24 as well as with the other various components as described herein, and may include a processor, such as a microprocessor, memory, logic devices, etc., not individually depicted for simplicity. The controller 32 may be part of a larger freighter computer network that coordinates emergency signals, for example a system that is integrated into aircraft electronics. In another embodiment, the controller 32 may be part of a stand-alone fire detection and suppression system 10, and may include an alarm on a cockpit panel that receives a wireless signal from the controller for enunciating an alarm condition.

Upon detection of the fire event, the controller 32 positions one or more of a series of secondary release valves 34 so that retardant 22 is precisely directed to the fire event. In an embodiment, each sensor 28 may be paired one-to-one (i.e., uniquely paired) with one secondary release valve 34 so that the fire suppression system 10 more accurately delivers retardant 22 to the detected location of the fire event. For example, if sensor 28 at Row C, Column 1 (i.e., location "1C") detects smoke or fire, the primary release valve 24 and the secondary release valve 34 at 1C are opened and all other secondary release valves remain closed so that retardant 22 is directed to location 1C. In this embodiment, retardant is ejected from only the one or more nozzles paired with the sensor detecting the fire. This is in contrast to some prior systems that flood an entire open space with retardant through all nozzles, which often requires a large volume and weight of retardant. Thus in an embodiment of the present teachings, the amount of retardant 22 required is reduced, as is the weight of the required stored retardant, compared to some prior fire suppression systems, as the system more precisely delivers the retardant 22 to the needed location. Decreasing fire suppression system weight reduces flight costs, for example fuel costs.

Figure 3A:
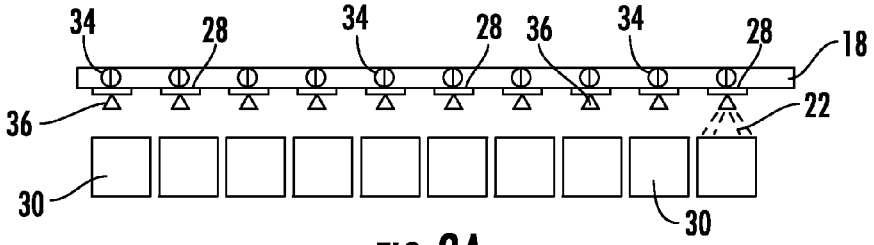
FIG. 3A is a schematic cross section of a portion of the FIG. 2 depiction.

FIG. 3A is a cross section along 3-3 of FIG. 2 during release of retardant 22 at location 1C. As discussed above, in an embodiment, each sensor 28 may be uniquely paired with one secondary release valve 34 as depicted in FIG. 3 so that the fire suppression system 10 more accurately delivers retardant 22 to the detected location of the fire event. Additionally, each sensor 28 and each secondary release valve 34 may be uniquely paired with one (or more) retardant delivery nozzle 36 that directs retardant 22 onto the precise location of the fire event. In an embodiment, the components of FIG. 3A, except for containers 30, are installed as a fixed part of the aircraft. The permanent components may be designed for an anticipated arrangement of containers 30, which may be used to transport cargo into and out of the aircraft.

Figure 3B:
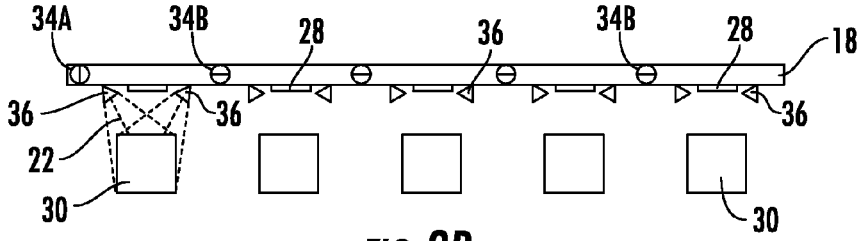
FIG. 3B is a schematic cross section of another embodiment.

Other arrangements of nozzles and detectors are also contemplated. For example, FIG. 3B depicts a cross section of an alternate embodiment having two or more retardant delivery nozzles 36 that direct retardant 22 onto the precise location of the fire event, for example onto one container 30. In the FIG. 3B embodiment, secondary release valve 34A may be positioned in the FIG. 4A configuration (described below) and secondary release valves 34B may be positioned in the FIG. 4B configuration to deliver retardant to the precise location of the fire event. It will be understood that the various embodiments are not limited to the number or position of the nozzles 36, containers 30, valves 24, 34, detectors 28, or rows/columns except where specified.

In another embodiment, if a fire event is detected at location 1C, other secondary release valves 34 adjacent to 1C may be opened to ensure sufficient fire control, such as locations 1B, 2B, and 2C. While delivering retardant to more than one location increases an amount of required retardant, the efficiency is improved compared to some prior systems that flood an entire open space with retardant during a fire event. Thus system weight may be reduced.

Figure 4A:
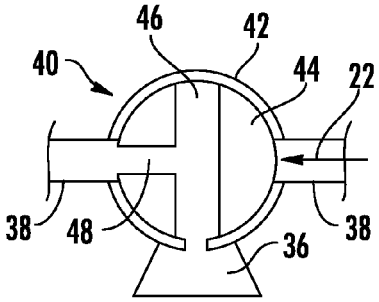
FIGS. 4A-4C are schematic cross sections of a valve that can be used in an embodiment of the present teachings.
Figure 4B:
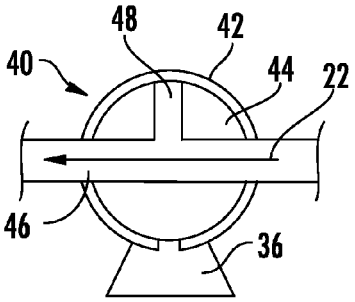
Figure 4C:
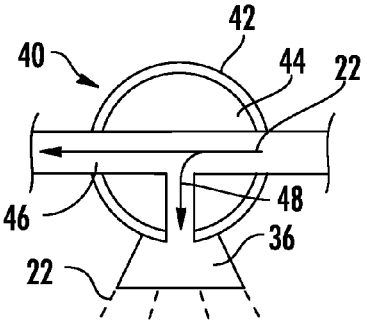

Various secondary release valve 34 configurations are contemplated. For example, two position electromechanical valves may be used, depending on a configuration of tertiary conduits 38A-38C, where the valve position is either ON or OFF so that retardant is either released or not released from a particular nozzle 36. In another configuration, three position electromechanical ball valves or diverters may be used, such as the electromechanical ball valve 40 depicted in FIGS. 4A-4C spaced along each of the conduits 38A-38C. These valves allow L-port and T-port flow paths, and may include a housing 42 that surrounds and seals an electrically-rotatable ball 44 within. In the position depicted in FIG. 4A, the secondary release valve 40 blocks retardant 22 from passing through either the nozzle 36 or to other downstream secondary release valves. In the position depicted in FIG. 4B, the secondary release valve 40 permits passthrough of retardant 22 to other downstream secondary release valves 40 (which may be open or closed), but blocks retardant 22 from exiting its paired nozzle 36. In the position depicted in FIG. 4C, the secondary release valve 40 allows passthrough of retardant to other downstream secondary release valves 40, and allows retardant 22 to flow through its paired nozzle 36. The proper position of each secondary release valve 40 is determined by controller 32 software and/or firmware based on the location of the fire event. The position is set by the controller 32, which may output a signal to a motor (i.e., electric actuator, not individually depicted for simplicity) associated with each ball valve 40. The dimensions and orientation of a passthrough channel 46 and a nozzle channel 48 within the ball 44 may be sized and configured to supply a desired amount of retardant 22 through the passthrough channel 46 and the nozzle channel 48. While FIG. 4 depicts the nozzle channel 48 intersecting the passthrough channel at an angle of 90°, other angles may be used to deliver a proper and predetermined amount of retardant 22 to the nozzle 36 when the valve is in the FIG. 4C position.

The conduits for transporting the retardant 22 from the retardant source 12 to the decks 18, 20 may include various configurations. For example, a primary conduit 14 transports fire retardant 22 from the retardant source 12 to the primary valve 24. A first deck (i.e., cargo deck) conduit 16 transports retardant 22 from the primary valve 24 to the secondary release valves 34 on the first deck, and a second deck (i.e., main deck) conduit 19 transports retardant 22 from the primary valve 24 to the secondary release valves 34 on the second deck. Tertiary conduits 38A-38C (FIG. 2) on each of the decks 18, 20 transport retardant 22 between the plurality of secondary release valves on each respective deck 18, 20.

Figure 5:
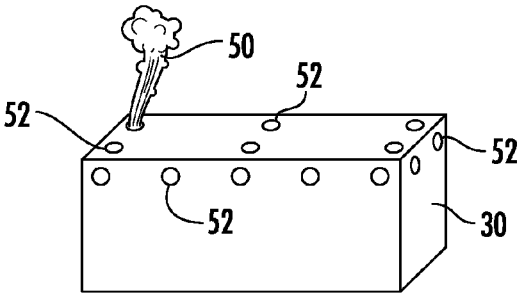
FIG. 5 is a perspective depiction of a cargo or shipping container in accordance with an embodiment of the present teachings.

In another aspect of the present teachings, depicted in the perspective depiction of FIG. 5, the cargo containers 30 in proximity to one or more of the sensors 28 may be configured so that heat, smoke, or other fire-indicative gasses 50 are allowed to more quickly escape a cargo container 30 for detection by a sensor 28. In the FIG. 5 embodiment, each cargo container 30 includes one or more apertures 52 for the passage of the fire indicator 50. Apertures 52 may be placed on one or more sides and/or the top of the container. While the apertures 52 may adversely provide increased oxygen to the inside of the container 30, a decrease in time from initial fire activity to fire detection may be useful in some implementations.

Figure 6A:
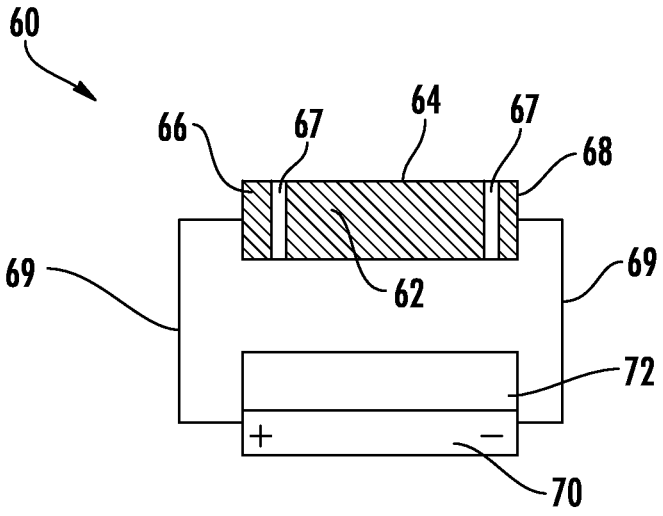
FIGS. 6A and 6B are cross sections of a heat detector (fire detector) in accordance with an embodiment of the present teachings.
Figure 6B:
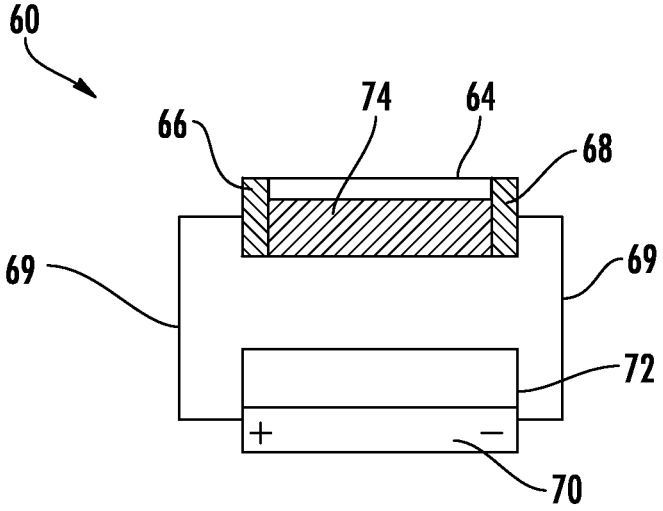

FIG. 6 is a schematic depiction of a heat sensor 60 that may be used on or within each container 30 in an embodiment of the present teachings. Heat sensor 60 may be used in place of, or in conjunction with, another sensor such as sensor 28 (FIG. 2). In this embodiment, an electrically conductive solid material 62 is located within a hollow tube 64 or other hollow container. The composition of the solid material 62 is selected such that it remains a solid at ambient temperatures and melts or flows at a temperature encountered during a fire. The solid material 62 may be, for example, lead, a lead alloy, or another suitable material. The material that forms the tube 64 is selected such that it remains a solid during high temperatures for a time sufficient to enable notification of a fire event. The heat sensor 60 may further include a first electrode 66 at a first end of the tube 64 and a second electrode 68 at a second, opposite end of the tube 64. One or both electrodes 66, 68 may be separated from the electrically conductive solid material 62 by a gap or space 67 within the tube 64 as depicted, such that the two electrodes 66, 68 remain electrically isolated from each other during normal operation. Each electrode 66, 68 is separately electrically coupled, for example with a trace or wire 69, to detector electronics that may include a battery 70 and a wireless transmitter 72 that may be powered by the battery 70. In an embodiment, the solid material 62, tube 64, and electrodes 66, 68 may be located within the container 30, while the transmitter 72 is located on an external surface of the container 30. In another embodiment, the entire heat sensor 60 may reside within the container 30. In another embodiment, the entire heat sensor 60 may reside outside of the container 30 such as on an external surface of the container 30.

During normal operation, the electrodes 66, 68 remain electrically isolated from each other such that the heat sensor 60 remains unpowered and inactive to preserve battery life. In another embodiment, the heat sensor 60 may be powered during normal operation, for example to output a signal to specify normal operation or to output results of a self test.

During a fire event, heat from the fire melts the solid material 62 within the tube 64 such that it becomes an electrically conductive liquid material 74 within the tube 64. The electrically conductive liquid material 74 electrically shorts the first 66 and second 68 electrodes together, which completes an electric circuit and causes activation of the wireless transmitter 72. The powered wireless transmitter 72 may output one or more signals and/or data streams to the controller 32. In an embodiment, the signal output by the wireless transmitter 72 may include data that notifies the controller 32 of the precise location of the heat sensor 60 and thus the precise location of the fire event. In another embodiment, the controller 32 may determine the location of the wireless transmitter 72, for example, through triangulation using sensors (not individually depicted for simplicity) within the cargo deck 18 and/or main deck 20. Thus heat sensor 60 may provide a reliable, low-cost technique for identifying the precise location of a fire event, as it relies on heat to sense the fire location rather than, for example, smoke which is more susceptible to being channeled away from the fire location by air currents.

The controller 32 may be in wired and/or wireless communication with one or more of the primary release valve 24 and the plurality of secondary release valves 34, as well as with other fire suppression system components and aircraft electronics. The primary release valve 24 and secondary release valves may be electromechanical valves such that the controller can control a position of each valve. Further, the controller 32 may be in wired and/or wireless communication with one or more of the plurality of sensors 28, such that the sensors 28 monitor a fire status over the sensor proximity and provide a fire status to the controller 32.

Some prior systems, such as systems using high rate discharge (HRD), output a large volume of retardant through all nozzles in a short time in an attempt to flood an entire open space to control a fire event, and thus use a large volume of gas over a short duration. HRD systems may subsequently use a secondary low rate discharge (LRD) system through all nozzles in an attempt to control any remaining fire for a duration of time that allows the aircraft to safely land. In an aspect of the present teachings, it is realized that oxygen supply in the cargo areas (for example, cargo deck 18 and main deck 20) may be less at higher altitudes. If a fire starts at higher altitudes, the lower oxygen supply may retard the growth of the fire such that it smolders until the aircraft descends to lower altitudes having increased oxygen. Because of the precise deployment of retardant to the fire event with the present teachings, a smaller retardant supply will allow for continuous retardant dispersal at the fire location during descent of the aircraft. Thus, in an embodiment, retardant is continuously dispensed at the precise location of the fire event beginning a time during descent, when descent begins, or from the time the fire event is identified. Once ejection of the extinguishing gas from the nozzle(s) is initiated, ejection may be continuous, for example, up until the time after the aircraft lands and is safely on the ground.

As retardant is ejected from less than all the nozzles on the deck on which fire is detected, for example from only the one or more nozzles paired with the sensor detecting the fire, the retardant supply is used sparingly at a low rate which allows retardant deployment for an extended period of time. If the fire continues to spread and is subsequently detected by other sensors, retardant can begin to be ejected from other nozzles paired with the other detecting sensors.

Thus an embodiment of the present teachings may include one or more elements. For example, one or more retardant nozzles may be uniquely paired with, and located in proximity to, a single fire event sensor (detector) of a plurality of fire sensors. Further, a plurality of secondary release valves may each be uniquely paired with one of a plurality of fire event sensors, and with one of a plurality of retardant nozzles. Uniquely pairing each secondary release valve with one sensor and with one nozzle places the release valve and nozzle in close proximity to the detector. With this arrangement of elements the fire is more quickly detected and the retardant is more precisely dispensed at the fire than with some prior systems.

It will be realized that, in other embodiments, two or more valves and nozzles may be paired with a single detector to cover a larger area with fewer components, for example to decrease costs, with the two or more valves and nozzles simultaneously delivering retardant. This may require more retardant than a system where each detector is uniquely paired with one secondary release valve, and may increase overall weight of the fire suppression system.

The close proximity of the nozzle to the sensor delivers retardant more precisely to the fire event location. The fire may then be more quickly controlled which requires a lesser amount of retardant than with some prior systems, which decreases the overall weight of the fire suppression system and flight costs.

In another embodiment, a fire suppression system in accordance with the present teachings may include one or more apertures through a surface of each cargo container so that heat, smoke, or other fire-indicative gasses are released from the cargo container more quickly before the fire has time to grow excessively. Detection will provide an action for the decompression of the cargo hold. No fire suppression action is required until the aircraft begins its descent. Activating the fire suppression system will provide fire protection during descent and minimize the quantity of extinguishing gas required to sustain concentration until aircraft has landed, thereby decreasing overall fire suppression system weight.

In an embodiment of the present teachings, a fire is more quickly detected than in prior systems, for example because of a higher density of sensors 28 across a cargo space 18, 20. An increased number of sensors 28 improves the likelihood (probability) that a sensor 28 is nearer to the origin of the fire, and thus the fire is more quickly detected. More rapid fire detection results in a more rapid initiation of emergency procedures while the fire is smaller, thus requiring a smaller on-board extinguishing gas supply and less weight.

Once the fire is detected, an embodiment of the present teachings may further include the use of an optional decompression of the cargo area. Decompression opens the relatively higher pressure cargo area to the relatively lower pressure atmosphere, thus venting oxygen to the atmosphere, decreasing the oxygen supply to the fire, and slowing the growth of the fire. This is particularly useful at low-oxygen altitudes, for example above about 25,000 feet. Decompression may be performed automatically at higher altitudes, for example at 25,000 feet or above, using a valve (not individually depicted for simplicity) that may be controlled using a wired or wireless signal output by the controller 32. One or more decompression valves used to decompress a cargo space of an aircraft are known in the art. Upon detection of a fire by a sensor 28, the controller 32 may send a wired or wireless signal to move the valve from a closed position to an open position to expose the deck to the atmosphere and to decompress the deck 18, 20 where the fire has been detected.

After decompression, an optional initial HRD which floods the cargo area with an extinguishing gas 22 ejected from some or all of nozzles 36 may be performed. Because of early fire detection and/or decompression, fire intensity and/or growth is retarded, particularly at higher altitudes, and the HRD may be delayed until the initiation of aircraft descent. Decompression further allows the descent and landing of the aircraft to be delayed if required, for example if the aircraft is over a large body of water. An HRD deployment alone may sufficiently retard or extinguish the fire such that subsequent extinguishing gas deployment is not at all required. In other embodiments, an optional extended LRD deployment of extinguishing gas 22 through one or more nozzles 36, but less than all nozzles 36, may be performed. The nozzle(s) through which extinguishing gas is deployed may be based on the location of the sensor that first detects the fire. An LRD deployment through less than all of the nozzles 36 decreases the rate of retardant use compared to systems that deploy retardant through all nozzles. Thus a smaller on-board emergency extinguishing gas supply (and a lower weight) is required. The LRD may be continued until after the aircraft has landed safely which, at maximum altitude, is expected to be 20 minutes or less under emergency conditions.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while a process may be described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. An aircraft fire suppression system for an aircraft comprising at least a first deck and a second deck, the fire suppression system, comprising: a fire retardant source;

a primary valve configured to selectively control a supply of fire retardant from the fire retardant source;

a first fire suppression system component for the first deck in selective fluid communication with the fire retardant source via the primary valve, comprising:

a plurality of first sensors on the first deck for detecting a fire; and a plurality of first retardant nozzles on the first deck, wherein each first retardant nozzle is in fluid communication with the fire retardant source and each at least one first retardant nozzle is uniquely paired. one-to-one, with one of the first sensors; and a second fire suppression system component for the second deck in selective fluid communication with the fire retardant source via the primary valve, comprising:

a plurality of second sensors on the second deck for detecting a fire; and a plurality of second retardant nozzles on the second deck, wherein each second retardant nozzle is in fluid communication with the fire retardant source and each at least one second retardant nozzle is uniquely paired, one-to-one, with one of the second sensors, wherein the first retardant nozzles and the second retardant nozzles are selectively operable to dispense fire retardant based on detection of a fire by the paired sensors, wherein the primary valve is configured to supply fire retardant to one of the first fire suppression system and the second fire suppression system based on a detection of a fire by one of the sensors of the first fire suppression system and the second fire suppression system;

wherein each of the plurality of first sensors and the plurality of second sensors comprises a heat sensor, comprising:

a hollow container having a first end and a second end;

a solid material within the hollow container, wherein the solid material has a melting point higher than ambient and lower than a temperature encountered during a fire;

a first electrode at the first end of the hollow container; and a second electrode at the second end of the hollow container, wherein the solid material is configured to melt and short the first electrode with the second electrode during a fire.

2. The aircraft fire suppression system of claim 1 wherein, upon detection of a fire by one of the plurality of sensors, the aircraft fire suppression system is configured to eject retardant from only the nozzle paired with the one of the plurality of sensors detecting the fire.

3. The aircraft fire suppression system of claim 1, further comprising:

a first plurality of shipping containers on the first deck, wherein one first sensor from the plurality of first sensors directly overlies one of the plurality of first shipping containers; and a second plurality of shipping containers on the second deck, wherein one second sensor from the plurality of second sensors directly overlies one of the plurality of second shipping containers.

4. The aircraft fire suppression system of claim 1, wherein each heat sensor further comprises a wireless transmitter configured to output a wireless signal when the first electrode and the second electrode are shorted together.

5. The aircraft fire suppression system of claim 1, further comprising:

a first plurality of shipping containers on the first deck and a second plurality of shipping containers on the second deck, wherein each of the first plurality of shipping containers and each of the second plurality of shipping containers comprises at least one aperture therein, wherein the at least one aperture in each container is configured to deliver a fire indicator to one of the plurality of sensors during a fire event within the container.

6. The aircraft fire suppression system of claim 1 wherein, upon detection of a fire by one of the plurality of first sensors on the first deck, the aircraft fire suppression system is configured to eject retardant from less than the plurality of first nozzles for a time period beginning with the detection of the fire and ending after the aircraft lands on the ground.

7. The aircraft fire suppression system of claim 1 wherein, upon detection of a fire by one of the plurality of first sensors on the first deck, the aircraft fire suppression system is configured to eject retardant from less than the plurality of first nozzles only during a period of time when the aircraft is descending and ending after the aircraft lands on the ground.

8. The aircraft fire suppression system of claim 1, further comprising:

a conduit in fluid communication with the fluid source and a plurality of the first nozzles, the primary valve located within the conduit;

a plurality of secondary valves positioned along the conduit, wherein one secondary valve is paired with each of the plurality of first nozzles, and each secondary valve may be selectively configured in a first position to block passage of retardant through the first nozzle paired with the secondary valve and block retardant passage downstream through the conduit, in a second position to block passage of retardant through the first nozzle paired with the secondary valve and permit passthrough of retardant downstream through the conduit, and in a third position to allow passage of retardant through the first nozzle paired with the secondary valve and allow retardant passage downstream through the conduit.

9. The aircraft fire suppression system of claim 8, wherein the conduit is a primary conduit, the primary conduit fluid connected to a first secondary conduit on the first deck and the plurality of secondary valves is a first plurality of secondary valves, and the aircraft fire suppression system further comprises:

a second secondary conduit on the second deck in fluid communication with the fluid source and a plurality of the second nozzles;

a plurality of second secondary valves positioned along the second conduit, wherein one second secondary valve is paired with each of the plurality of second nozzles, and each second secondary valve may be selectively configured in the first position to block passage of retardant through the second nozzle paired with the second secondary valve and block retardant passage downstream through the second conduit, in the second position to block passage of retardant through the second nozzle paired with the secondary valve and permit passthrough of retardant downstream through the second conduit, and in the third position to allow passage of retardant through the second nozzle paired with the secondary valve and allow retardant passage downstream through the second conduit.

10. The aircraft fire suppression system of claim 9, further comprising a controller in electrical communication with the plurality of first secondary valves and the plurality of second secondary valves, wherein the controller is configured to separately position each of the plurality of valves in one of the first, second, and third positions based on a location of a detected fire to direct retardant to the location of the detected fire and to selectively ejected retardant from less than the plurality of nozzles on one of the first deck and the second deck.

11. A fire suppression system of an aircraft, comprising: a fire retardant source;

a primary release valve in fluid communication with the fire retardant source; a first conduit and a second conduit each in fluid communication with the primary release valve, the primary release valve configured to selectively supply fire retardant from the fire retardant source to one of the first conduit and the second conduit;

a first fire suppression system component for a first deck of the aircraft in fluid communication with the first conduit, the first fire suppression system component comprising:

a plurality of first deck sensors for detecting a fire;

a plurality of first deck secondary release valves, wherein each first deck secondary release valve is uniquely paired, one-to-one, with one of the plurality of first deck sensors; and a plurality of first deck fire retardant delivery nozzles, wherein each first deck fire retardant delivery nozzle is uniquely paired, one-to-one, with one of the plurality of first deck sensors; and a second fire suppression system component for a second deck of the aircraft in fluid communication with the second conduit, the second fire suppression system component comprising:

a plurality of second deck sensors for detecting a fire;

a plurality of second deck secondary release valves, wherein each second deck secondary release valve is uniquely paired, one-to-one, with one of the plurality of second deck sensors; and a plurality of second deck fire retardant delivery nozzles, wherein each second deck fire retardant delivery nozzle is uniquely paired, one-to-one, with one of the plurality of second deck sensors, wherein the first deck fire retardant delivery nozzles and the second deck fire retardant delivery nozzles are selectively operable to dispense fire retardant based on detection of a fire by the paired sensors; and wherein each of the plurality of first deck sensors and the plurality of second deck sensors comprises a heat sensor, comprising:

a hollow container having a first end and a second end;

a solid material within the hollow container, wherein the solid material has a melting point higher than ambient and lower than a temperature encountered during a fire;

a first electrode at the first end of the hollow container; and a second electrode at the second end of the hollow container, wherein the solid material is configured to melt and short the first electrode with the second electrode during a fire.

12. The fire suppression system of claim 11, further comprising:

a primary conduit for transporting fire retardant from the fire retardant source to the primary release valve;

wherein, the first conduit is a first deck secondary conduit for transporting fire retardant from the primary valve to the plurality of first deck secondary valves;

wherein, the second conduit is a second deck secondary conduit for transporting fire retardant from the primary valve to the plurality of second deck secondary valves;

the system further comprising a first deck tertiary conduit for transporting fire retardant between the plurality of first deck secondary valves; and a second deck tertiary conduit for transporting fire retardant between the plurality of second deck secondary valves.

13. The fire suppression system of claim 11, wherein each of the plurality of secondary release valves is an electromechanical ball valves configurable to each of:

a first position that blocks retardant from passing through the nozzle paired with the secondary release valve and blocks retardant from passing through the secondary release valve to one or more downstream secondary release valves;

a second position that blocks retardant from passing through the nozzle paired with the secondary release valve and permits retardant to pass through the secondary release valve to one or more downstream secondary release valves; and a third position that permits retardant to pass through the nozzle paired with the secondary release valve and permits retardant to pass through the secondary release valve to one or more downstream secondary release valves.

14. The fire suppression system of claim 11, further comprising one or more cargo containers for storing cargo during transport in proximity to at least one of the sensors, wherein each of the one or more cargo containers comprises at least one aperture configured to deliver a fire indicator to one of the plurality of sensors during a fire event within the container.

15. The fire suppression system of claim 11 configured to, upon detection of a fire by one of the sensors, to eject retardant from only the fire retardant delivery nozzle that is uniquely paired with the sensor detecting the fire.

16. The fire suppression system of claim 11, wherein each heat sensor further comprises a wireless transmitter configured to output a wireless signal when the first electrode and the second electrode are shorted together.

17. The fire suppression system of claim 11 wherein, upon detection of a fire by one of the plurality of first deck sensors when the aircraft is in flight, the fire suppression system is configured to eject retardant from less than the plurality of first nozzles for a time period beginning with the detection of the fire and ending after the aircraft lands on the ground.

18. The fire suppression system of claim 11 wherein, upon detection of a fire by one of the plurality of first sensors on the first deck when the aircraft is in flight, the fire suppression system is configured to eject retardant from less than the plurality of first nozzles only during a period of time when the aircraft is descending and ending after the aircraft lands on the ground.

* * * * *